United States Patent [19]

Jackson et al.

[11] 4,365,836

[45] Dec. 28, 1982

[54] MOTORIZED RECLINING CHAIR

[75] Inventors: William R. Jackson, Cleveland, Tenn.; Edwin G. Chambers; Albert J. Kraus; Wesley E. Lerdon, all of Columbus, Ohio

[73] Assignee: Cleveland Chair Company, Cleveland, Tenn.

[21] Appl. No.: 182,815

[22] Filed: Aug. 29, 1980

[51] Int. Cl.[3] ..... A47I 1/024

[52] U.S. Cl. ..... 297/85; 297/68; 297/330; 297/342

[58] Field of Search ..... 297/85, 89, 330, 88, 297/68, 84, 83, 341, 342; 280/200, 226, 230, 242 WC

[56] References Cited

U.S. PATENT DOCUMENTS

| | | | |
|---|---|---|---|
| 2,564,762 | 8/1951 | Howard et al. | 297/68 X |
| 2,714,922 | 8/1955 | McKibban et al. | 297/330 X |
| 2,770,233 | 11/1956 | Thomas | 297/330 X |
| 2,944,595 | 7/1960 | Barabas et al. | 297/85 |
| 3,016,264 | 1/1962 | Hughes | 297/85 X |
| 3,147,038 | 9/1964 | Barabas | 297/316 X |
| 3,433,527 | 3/1969 | Re' | 297/85 |
| 3,476,495 | 11/1969 | Church | 297/330 X |
| 3,522,969 | 8/1970 | Re' | 297/85 |
| 3,588,170 | 6/1971 | Knabusch | 297/330 X |
| 3,719,391 | 3/1973 | Neri | 297/341 |
| 3,934,927 | 1/1976 | Zur | 297/330 X |
| 4,007,960 | 2/1977 | Gaffney | 297/330 X |
| 4,061,397 | 12/1977 | Lewis | 297/330 |
| 4,183,578 | 1/1980 | Naganawa | 297/330 X |

FOREIGN PATENT DOCUMENTS

| | | | |
|---|---|---|---|
| 1180336 | 2/1970 | United Kingdom | 297/330 |
| 1434307 | 5/1976 | United Kingdom | 297/317 |

*Primary Examiner*—James T. McCall

*Attorney, Agent, or Firm*—Gottlieb, Rackman & Reisman

[57] ABSTRACT

There is disclosed a motorized reclining chair. All motions are controlled by a single reversible motor, the cost of the motor being offset by the relatively low cost of the linkages which are employed. The chair offers numerous advantages, including: (1) leg-rest motion takes place without set/back motion until the leg rest is raised to an intermediate position, following which the leg rest and seat move together, (2) three-way operation, in which the back tilts relative to the seat, can be provided at minimum additional cost, simply by pivoting the back to the seat and adding a single link on each side of the chair, and (3) in moving to the fully reclined position, the entire seat rises, with the front edge rising more than the rear edge, as contrasted with prior art reclining chairs in which the rear of the seat drops down. The motive force is provided by an upwardly thrusting shaft controlled by the motor. Instead of utilizing the motor to assist motion of a prior art type mechanism, the mechanism itself operates in a totally different way.

71 Claims, 12 Drawing Figures

20
20a
20b
20c
7
7
36
38
36a
36b
36c
36d
36e
44
45
46
48
50
52
54
26a
26b
26c
26d
28
28a
28a'
30
24a
24d
24e
24f
24g
24h
24i
32
32a
32b
32c
32d
32e
34
40
41
47
49
60
62

MOTORIZED RECLINING CHAIR

This invention relates to reclining chairs, and more particularly to reclining chairs in which motions are controlled by a motor.

There are numerous linkage arrangements which have been proposed in the prior art for controlling the operations of reclining chairs, as evidenced both by the extensive patent literature and the numerous commercial chairs which are to be found on the market. A reclining chair generally takes one of two forms. In a two-way chair, the seat and back are rigidly connected; in moving from the upright position to the fully reclined position, the leg rest rises and the seat/back tilts backward. In a three-way chair, the back is pivoted to the seat; in moving from the upright position to the fully reclined position, there is an additional tilt of the back relative to the seat.

In both types of chair (as in the illustrative embodiments of the invention), the seat is sometimes made to move forward in reclining positions so that the chair can be placed near a wall; even though the seat/back tilting causes the top of the back to move toward the wall, by having the seat move forward the chair need not be placed several feet from the wall.

There have been attempts in the prior art to motorize reclining chair operation. (The "closest" prior art known to applicants is Gaffney U.S. Pat. No. 4,007,960 but, except for certain superficial similarities, the Gaffney motorized chair has little in common with that of the present invention.) The approach which has generally been taken is to provide a motor which complements the otherwise mechanically-controlled motion (see, e.g., Lewis U.S. Pat. No. 4,061,397). In other words, one or more motors are added to an existing design in order to aid motion of the several elements, but the physical constraints of the prior art linkages are not overcome. What has been done is to adapt motors to existing designs, rather than to recognize that the use of a motor allows new types of motion.

In those conventional reclining chairs, or recliners, which do not include special levers, the motive force is derived by the occupant pushing against the back of the chair. The back starts to move, and the linkage mechanisms in the chair cause the leg rest to rise and the seat to be tilted. Prior art motorized configurations have simply assisted this type of sequencing. We have discovered that the provision of a motor-derived thrust underneath the seat in a generally upward direction not only allows the use of greatly simplified linkages, but also permits a new type of sequencing.

It is a general object of our invention to provide a motorized reclining chair which allows greatly simplified linkages to be employed, and which also controls a sequencing which is far more advantageous than those exhibited by prior art reclining chairs.

The chair of our invention, in the illustrative embodiments thereof, includes a seat which is coupled to a stationary frame by two quadrilateral linkages, one on each side of the chair. The seat is coupled to a leg rest by a conventional-type extender mechanism. The motive force is not derived by the occupant pushing against the back of the chair. Instead, a motor-driven shaft underneath the seat pushes against the leg rest extender mechanism. Initially, the thrust is primarily horizontal and the leg rest starts to move. The thrust soon changes direction, however, so that it becomes more upwardly oriented. As the leg rest first starts to move, the seat and back remain fixed in place. But once the leg rest reaches an intermediate position, it remains fixed relative to the seat; a continued upward thrust on the leg rest extender mechanism causes the leg rest to further rise and the seat to start tilting backward. In the two-way embodiment of our invention, the seat and back are rigidly connected and tilt together. In the three-way embodiment, the back is pivoted for rotation relative to the seat, and an additional link is provided on each side of the chair for connecting the back to the quadrilateral linkage. This is all that is required in order to cause the back to rotate relative to the seat at the same time that the seat tilts.

Because all motion is controlled by an upwardly directed force underneath the seat, rather than a reclining force against the back, in a sense the chair of our invention is an "up-cliner" rather than a "re-cliner" although there are, of course, similarities between the operation of our chair and those of the prior art. A major distinction in the functioning of the chair is that body weight and physical exertion by the occupant have little to do with the actual chair motion.

The linkage mechanisms employed in the illustrative embodiments of our invention are remarkably simple, thus tending to offset the cost of the motor and drive mechanism. (Costs are further reduced by having some of the links symmetrical in design so that they can be used on both sides of the chair, even though their orientations are opposite to one another.) Additional advantages of our design are the following:

(1) There is no need to shift body weight or to push or pull with the arms or legs in order to control motion of the chair. All motions, even the extra sequencing required of a three-way chair, are controlled by a single reversible motor. (2) The first motion in moving from the upright position with a prior art reclining chair is that of the back; the back tilts backward, with or without the seat (depending on whether the chair is a two-way or three-way design), because it is the motion of the back which controls movement of the leg rest. In the chair of our invention, on the other hand, it is only the leg rest which first moves. Until it is raised to a predetermined intermediate position, there is no motion of the seat or back. Only after the leg rest is raised to this position does the seat start tilting (with the back not only moving with the seat, but also further tilting relative to it if the two additional links are provided as described above). Although some prior art reclining chairs did allow for independent motion of the leg rest, they required the use of separate levers or complicated-to-operate mechanisms. It is important to provide simple control over leg-rest motion alone, because most often a reclining chair is used to watch television, or for some other purpose for which what is really desired is not a reclining position for the chair, but rather only an upraised leg rest. The chair of our invention allows independent leg rest motion (and stopping of the leg rest in any desired position) without any concomitant motion of the seat and back, as long as the leg rest is not moved beyond the predetermined intermediate position.

(3) The independent leg rest operation has a great appeal to many women. It has been found that many women will not even move a reclining chair to the fully reclined position because of modesty considerations. They would in fact rather not move the seat and back at all, except that the back must be moved in order to raise the leg rest. The chair of our invention has great appeal to these consumers because the leg rest can be raised without the seat and back moving at all.

(4) In moving to a reclining position, the seat of our invention tilts backward, as in conventional chairs. But the entire seat is also raised with the front edge of the seat being raised more than the rear edge of the seat. This is to be distinguished from prior art chairs in which the rear edge of the seat is actually lowered in a reclining position. It has been found that numerous users feel more "secure" in the chair when the entire seat is lifted as the chair reclines.

(5) When the chair is returned from the fully reclined position to the upright position, the various links retrace their motions. This means that the seat and leg rest move together as an integral unit until the predetermined intermediate position is reached, at which time the seat is in its upright position. Thereafter, the leg rest continues to move alone to the fully retracted position. This type of motion (controlled by specially provided springs in the illustrative embodiments of the invention, as will be described below) also contributes to a more secure feeling. It is to be contrasted with prior art chairs in which the seat and leg rest move relative to each other throughout most of the chair sequencing.

(6) Because the motor can be stopped in any position in going from the upright to the fully reclined position, or vice versa, the chair can assume any of an infinite number of positions depending on what is more comfortable to the user. This is to be distinguished from prior art chairs in which it is generally not possible for the chair to assume more than one intermediate position.

(7) The linkage mechanisms allow the chair to have less depth and less height, and thus reclining chairs may be manufactured which are not big, bulky and out of proportion with other living room furniture. Even the three-way chair of our invention can be placed as close as about six inches to a wall; despite the fact that the back tilts relative to the seat, because the seat actually moves forward as the chair assumes a reclining position, only a little clearance is necessary to prevent the back from hitting the wall even in the fully reclined position.

(8) In a conventional three-way reclining chair, the seat moves rearwardly relative to the bottom of the back; this prevents the use of loose T-cushion styling because as the seat moves back, the rear of the cushion is pushed forward relative to the seat by the back. But because the seat of our three-way chair does not move rearwardly relative to the bottom of the back, T-cushions may be used.

(9) While it may not be apparent, many sales of reclining chairs are lost, especially to women (the major consumers), because users are not always familiar with the proper way to operate a reclining chair. A preliminary failure in a showroom often results in a lost sale. With the reclining chair of our invention, however, there can be no failures—all that is required is to push a button.

(10) A major advantage of the design of our invention is that a two-way chair can be converted to a three-way chair at minimum expense. It is, of course, necessary to pivot the back to the seat, rather than to provide a single rigid assembly. But instead of requiring a completely separate reclining mechanism, the two-way mechanism of our invention may be utilized simply by adding an additional linkage to each side of the chair.

(11) It is well known that with many prior art three-way reclining chairs, the tilting of the back relative to the seat is accompanied by the bottom of the back rising slightly; this pulls upward on the occupant's shirt and sometimes pulls it out of the occupant's pants. This is totally eliminated in the chair of our invention, in which the back does not rise relative to the seat.

Further objects, features and advantages of our invention will become apparent upon consideration of the following detailed description in conjunction with the drawing, in which.

Figure 1:
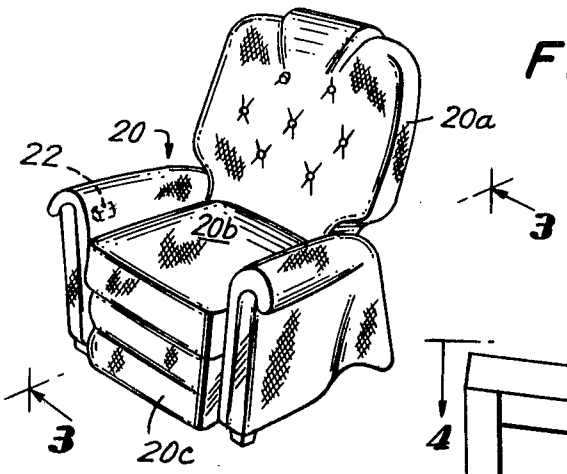
FIG. 1 is a perspective view of a two-way chair constructed in accordance with the principles of our invention.
Figure 2:
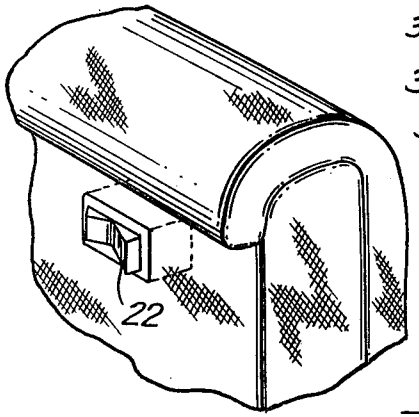
FIG. 2 is a detail of the chair of FIG. 1 and shows the position of the motor-controlling switch.

Chair 20 of FIG. 1 includes a back **20*a*, a seat cushion 20*b*, and a leg rest 20*c*. The manner in which the chair is upholstered is not important to an understanding of the present invention and, in the several figures which depict the chair construction, only the frame members are shown. The chair of FIG. 1 includes a switch 22, shown in greater detail on FIG. 2**, which is placed on a side of one of the chair arms. The switch has three positions—forward, reverse and off, and it is connected by wires to the internal motor to be described below. The wire connections themselves, as well as the power line connections, are not shown, it being understood that the power and switch connections to the motor are purely conventional. We also contemplate that instead of providing the switch on an arm of the chair, it can be attached to the end of a loose cord; while perhaps not as convenient to the user, such a cord makes upholstering of the chair easier for the manufacturer.

Figure 3:
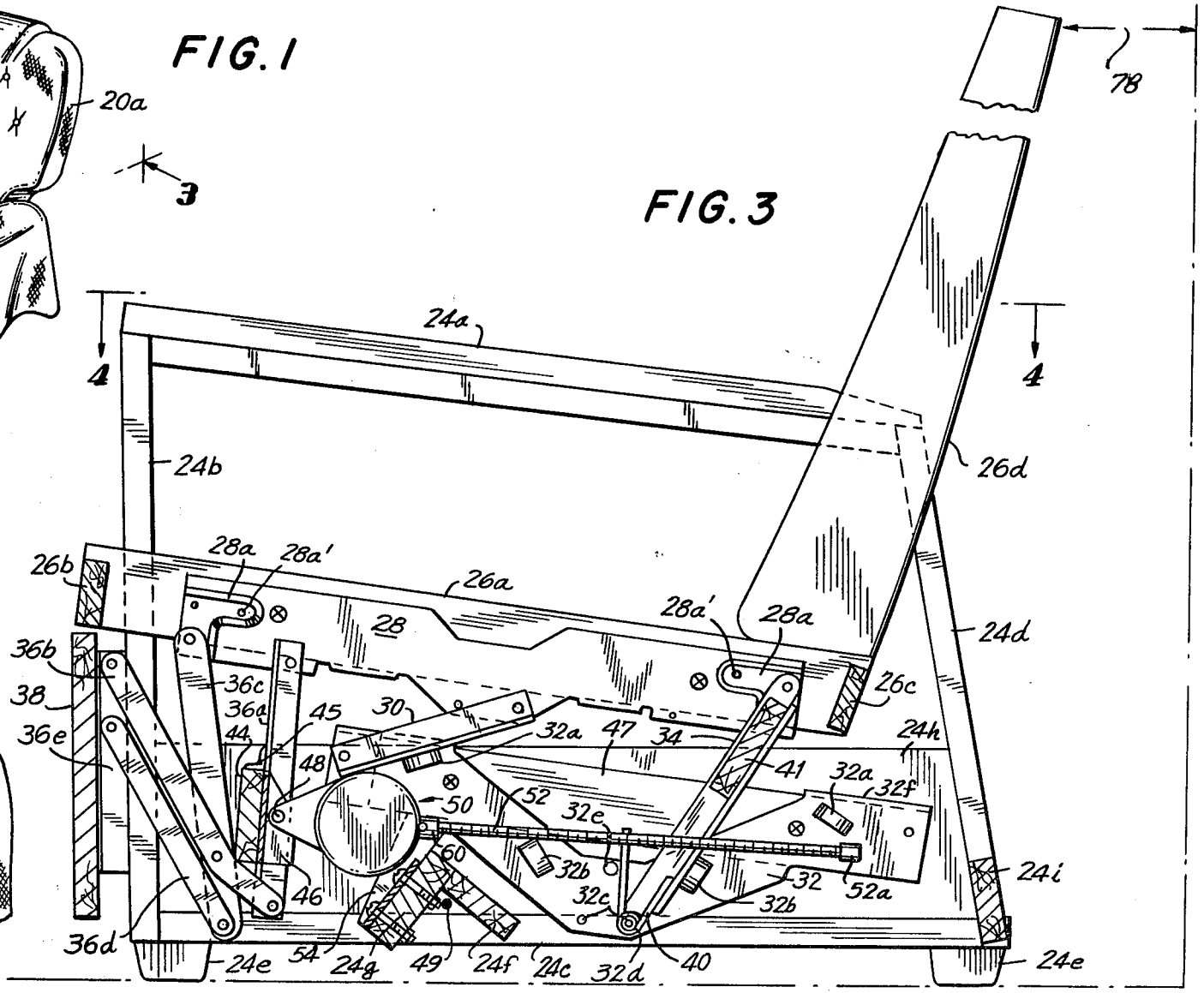
FIG. 3 is a sectional view taken through the line 3—3 of FIG. 1.
Figure 4:
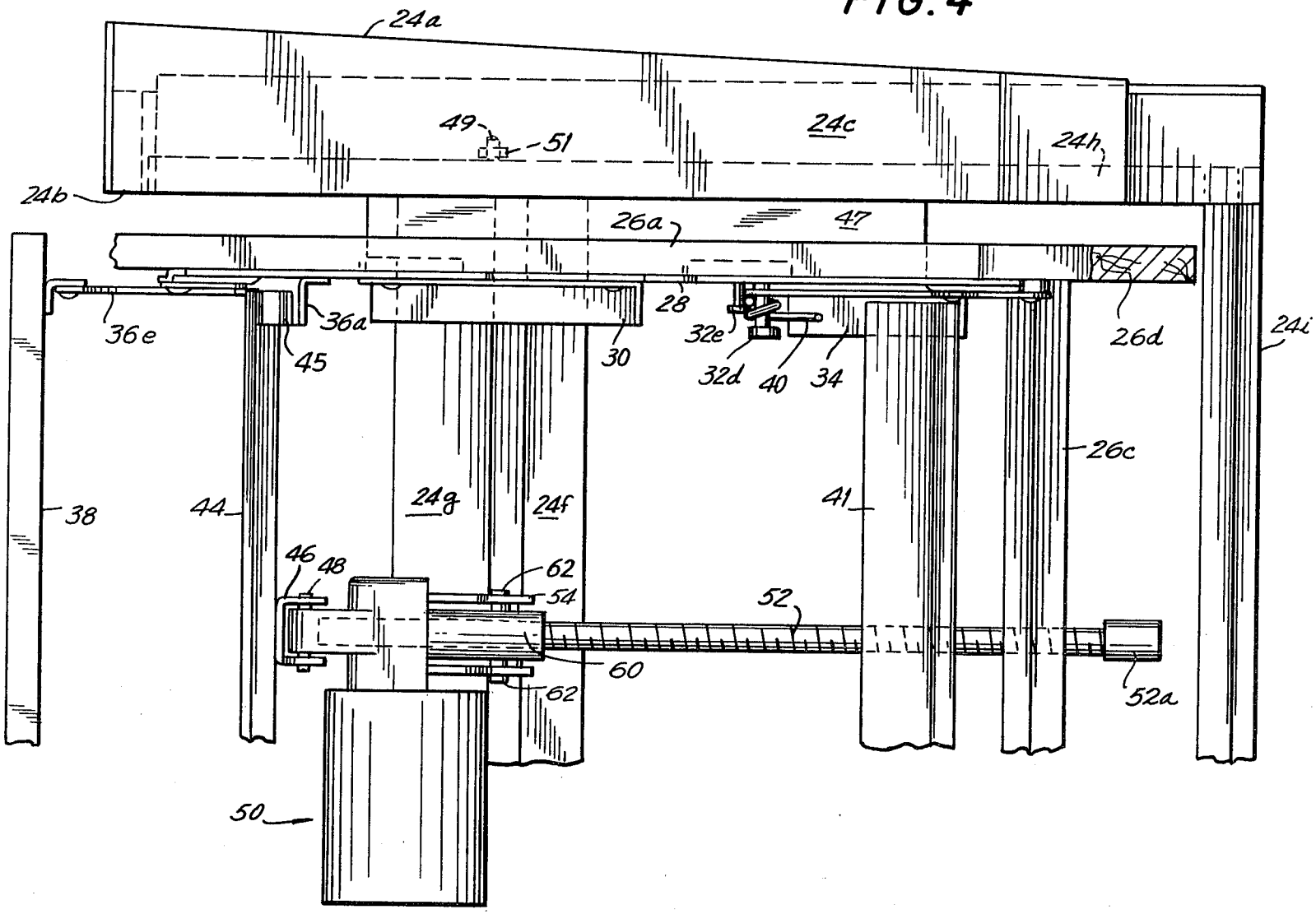
FIG. 4 is a sectional view taken through the line 4—4 of FIG. 3.
Figure 5:
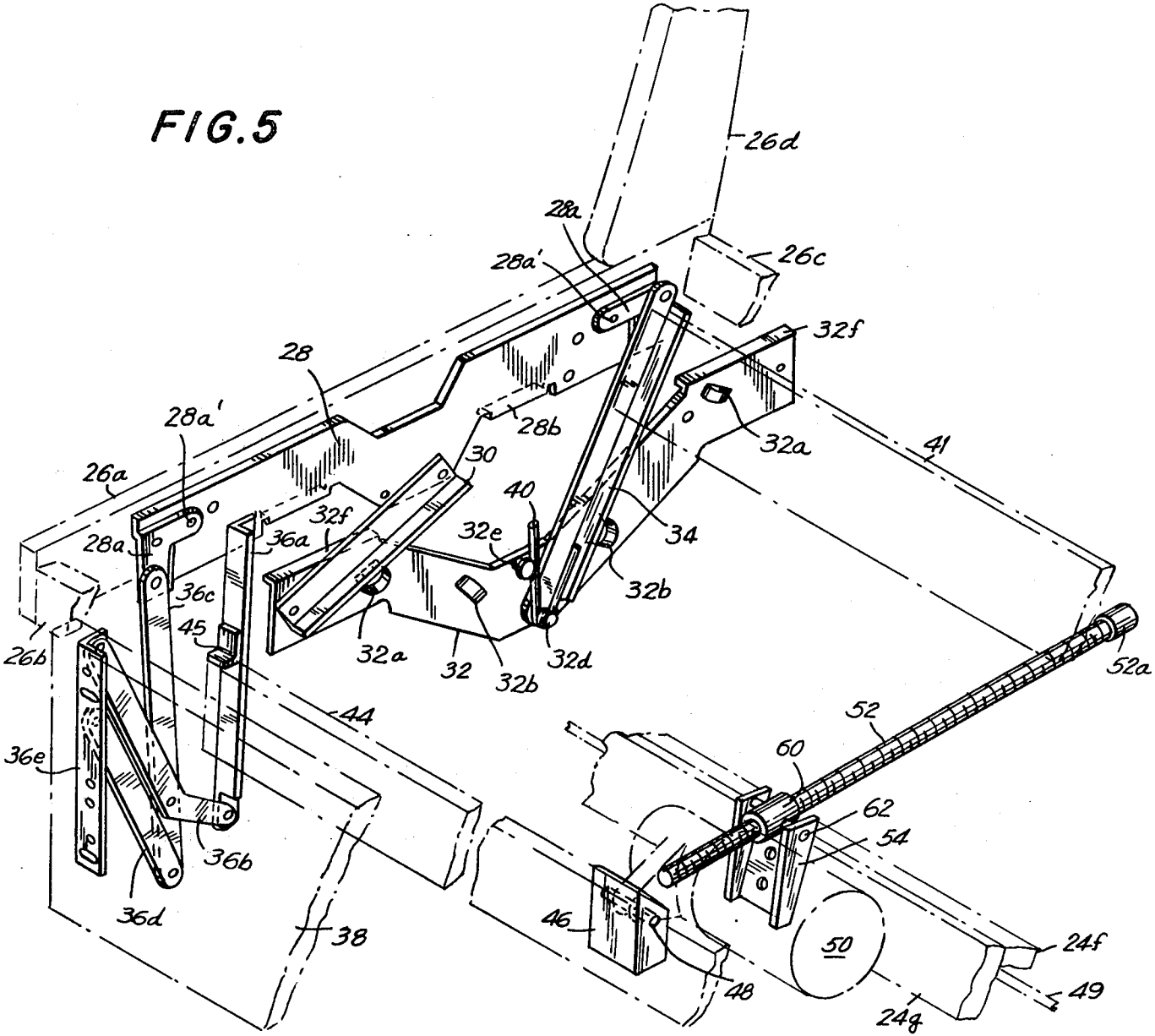
FIG. 5 is a perspective view which partially shows the linkages employed in the illustrative embodiment of our invention.

FIGS. 3, 4 and 5 depict the various wood frames involved in the construction of the chair, as well as the mechanisms of our invention. There are two main wood frames, one of which is stationary and one of which serves as a seat/back support for an occupant. The frame for the seat and back consists of two side sections **26*a*, and a back section 26*d* rigidly secured to them in a conventional manner. As will be described below, because the seat/back frame moves forward in a reclining position at the same time that it tilts, relatively little clearance is required between the chair and a wall near which it is placed. Numeral 78 in FIG. 3 shows this clearance and with the two-way chair of our invention, the required clearance is only about four inches. (With the three-way chair of FIGS. 10–12, about 6.5 inches of clearance are required; the additional space is necessary because the back tilts relative to the seat in the reclining positions.) Two additional cross-frame members 26*b* and 26*c* are provided for connecting the two side sections 26*a* of the seat/back frame. (Although not shown, additional cross members can be provided for the back 26*d***, as is known in the art.)

The stationary frame includes on each side an arm rest **25*a*, a bottom section 24*c*, and two substantially vertical sides 24*b* and 24*d*. A pair of legs 24*e* are provided on each side, as is standard practice in the art. The two sides of the stationary frame are interconnected by two angled cross-members 24*f*, 24*g* (required for mounting of the motor trust assembly, as will be described below), and cross-member 24*i***. Throughout the drawing, for the sake of clarity, the manners in which many frame members are attached to others are not always shown; standard fastening techniques are employed. The wood construction and link-riveting techniques required to actually build a chair are well known in the art.

On each side of the frame, as seen most clearly in FIG. 3, there is a panel **24*h*. Attached to each of these panels is a board 47, on which a link of the primary linkage on each side of the chair is screwed, as will be described below. A tie rod 49 is also provided which extends from one side of the chair to the other and passes through the two panels 24*h*, the two ends of the tie rod being secured by nuts 51 (see FIG. 4**); the tie rod, which is maintained under tension, is of conventional design and further serves to secure the two sides of the stationary frame.

On each side of the chair there is a quadrilateral linkage mechanism. Only four links are required for each primary linkage mechanism in the illustrative embodiments of the invention. Each of these primary linkages consists of links 28, 30, 32 and 34, as seen most clearly in FIGS. 3 and 5. A first link, link 32, is screwed to a respective board 47, as seen most clearly in FIG. 3. It should be noted that this link includes two flanges **32*f* (see FIG. 5) for locating the link on board 47. This facilitates placing the link on the board during manufacture so that only one worker is required to hold and screw it in place. Because the forces on the link are in the downward direction, the flanges also prevent the full load being borne by the screws. The two links 32, one on each side of the chair, are symmetrical. Because the flanges must be directed inwardly on each side of the chair, it is apparent that the two links must be oppositely oriented. By making them symmetrical, only a single stamping operation is required. Each of links 32 includes a first pair of stops 32*a* and a second pair of stops 32*b*. One of stops 32*a* in FIG. 3 bears against link 30 when the chair is in the upright position, and one of stops 32*b* bears against link 34. The others of stops 32*a* and 32*b*, in the link 32 which is shown in FIGS. 3 and 5, are not used. However, it is these two other stops on the link 32 at the other side of the chair which are used, due to the symmetry of the stamping. Each of links 32 includes a central riveted stop 32*e* which will be described below. It also includes a pair of holes 32*c*, one of which is used on each side of the chair for attachment of links 32 and 34 by a riveted mandrel, the mandrel also supporting a torsion spring 40**.

The second link in each primary linkage is link 28 which is attached to the seat/back frame section **26*a*, as shown most clearly in FIGS. 3 and 5. This link also includes a pair of flanges 28*b* for bearing against the underside of section 26*a*. The flanges permit the link to be located by the same worker who screws it in place. The flanges in this case are on the underside of the wood frame because the forces on the link as the chair is operated are directed upwardly. At each end of link 28 there is an embossment 28*a* so that the connected links 36*c* and 34 pivot against the embossments only, rather than a larger surface area. (The embossments also allow rivets to be put in place without their bearing against section 26*a***.) The link is symmetrical as shown in order that the same-shaped link be useable on both sides of the chair even though the two links are oppositely disposed. Some of the other links in the overall mechanism are also symmetrical for the same reason, as will be apparent from the drawing.

The first and second links on the primary linkage mechanism on each side of the chair are thus connected respectively to the stationary frame and the moveable seat/back occupant support. These two links are connected to each other on each side of the chair by links 30 and 34, as seen most clearly in FIG. 5. Standard riveting techniques are employed throughout the construction.

On each primary linkage, a torsion spring 40 is provided. The spring is mounted on mandrel **32*d*, and its two ends bear against riveted stop 32*e* and the rear leg of the link 34 (see FIG. 5). The torsion spring (or any other equivalent device which is employed) biases the primary linkage in the upright position, that is, the position shown in FIG. 3. Link 32 always remains in the same position relative to the stationary frame since it is screwed to it. The torsion spring biases link 34 in the clockwise direction until it bears against stop 32*b*. This, in turn, causes the seat to be moved toward the rear of the chair, and link 30 to rotate in the clockwise direction until it bears against stop 32*a*. As will be described below, as the chair is moved to a reclining position against the spring bias, the seat moves forward and up relative to the stationary frame. The path of travel of the seat, secured to link 28, is determined by links 30 and 34**.

As best seen in FIGS. 3 and 5, a conventional leg rest extender linkage 36 is connected between link 28 and leg rest board 38 on each side of the chair. The extender mechanism, or scissors, consists of five links **36*a*–36*e*, with link 36*e* being screwed to one end of leg rest board 38. Links 36*a* and 36*c* are pivoted to link 28 as shown. A small angle bracket 45 is secured to link 36*a*; as the linkage is extended, as will be described below, in order to raise the leg rest, eventually bracket 45 bears against link 36*c*. Once this happens, there is no longer any relative motion of the links in the extender mechanism (see FIG. 7**).

Two boards 41 and 44 are also provided for support purposes, connected between pairs of links 34 and **36*a*, as seen most clearly in FIG. 5. Board 44 further serves to support bracket 46**; this bracket is the bracket to which the motor applies a substantially horizontal thrust at the beginning of the chair movement, with the thrust direction becoming more and more upward as the chair motion progresses, as will become apparent below.

The motor/shaft arrangement is depicted most clearly in FIGS. 3, 4 and 5. Swivel bracket 46 is secured to board 44 in the center of the chair. A pivot 48 in the bracket is used to mount the clevis extension of the motor/gear box 50. The gear box, of conventional design, serves to transmit a driving force from the motor to shaft 52, the shaft having the form of a long lead screw. the shaft passes through a nylon (self lubricating) swivel nut 60, the two sides of which are pivoted at 62 to bracket 54. Bracket 54, in turn, can be attached by a pair of screws to board 24*g*, as seen most clearly in FIG. 5.

Figures 8, 9:
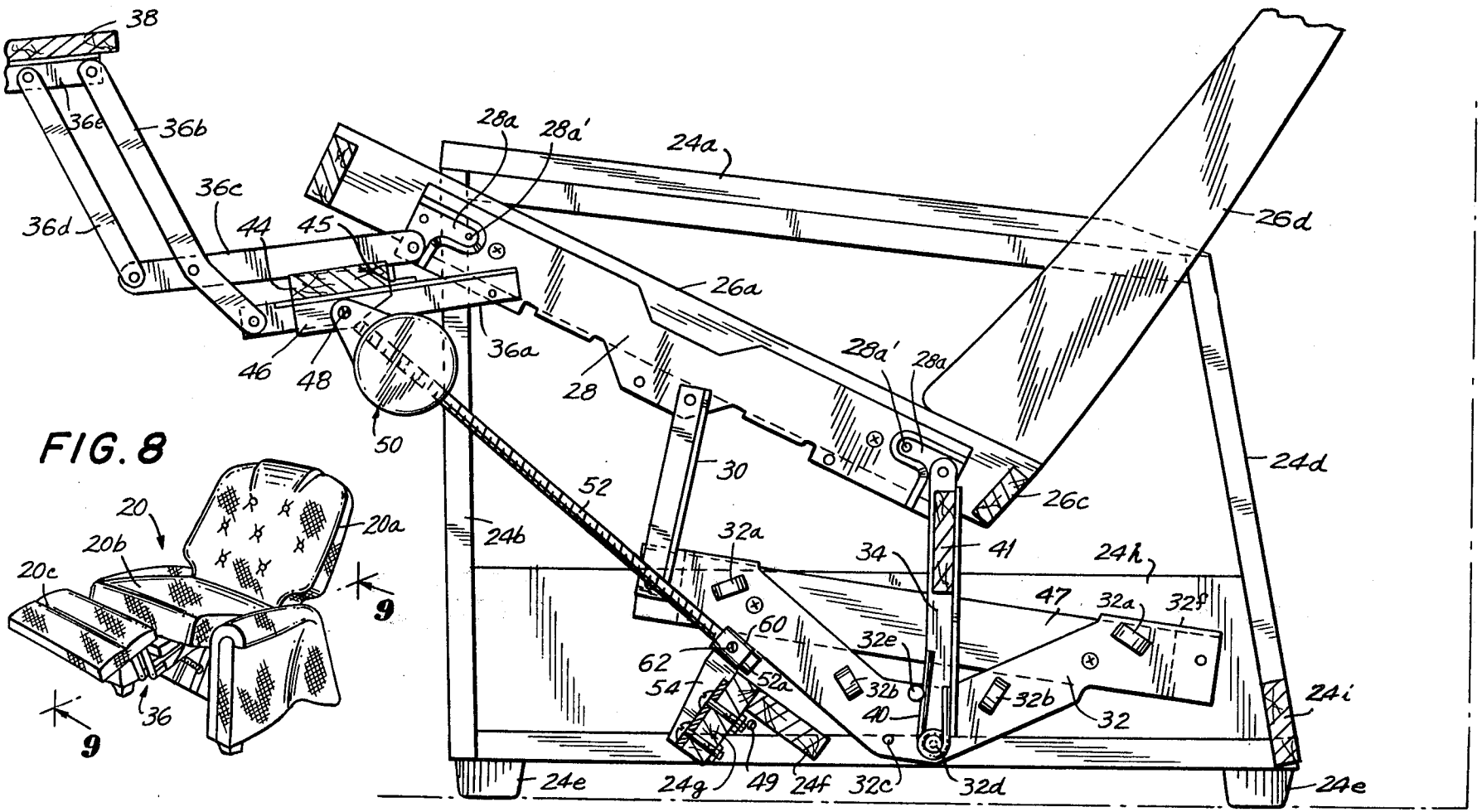
FIG. 8 is a perspective view of the chair of FIG. 1 in the fully reclined position.
FIG. 9 is a sectional view taken through the line 9—9 of FIG. 8.

It is the distance between pins 48 and 62 that controls the chair motion. The minimum distance is that shown in FIGS. 3 and 5. It will be noted that the gear box in this position bears against nut 60 (see FIG. 4) so that even if the motor is operated in the reverse direction to retract the leg rest, it cannot be retracted beyond the position shown in FIGS. 3–5. The motor/gear box includes a slip clutch which prevents turning of shaft 52 in this position. (As an alternative, limit stops can be provided on the motor as is known in the art, to cause the motor to stop operating when either the forward or reverse limit is reached). When the motor is operated in the forward direction and shaft 52 turns within nut 60, the distance between pivots 48 and 62 increases, a predetermined intermediate position being shown in FIG. 7. The fully reclined position of the chair is shown in FIG. 9, with the pivots being separated by the maximum distance. Cap 52*a*, attached to the end of the shaft, bears against nut 60 in the fully reclined position of FIG. 9 to prevent further turning of the shaft even if the motor continues to be operated in the forward direction, the slip clutch serving to allow the motor to continue operating without turning the shaft.

It should be noted that while the thrust applied to the extender mechanism in the upright position of FIG. 3 is substantially horizontal, the direction of the thrust changes as the chair moves to successively reclining positions. In the intermediate position of FIG. 7, in which bracket 45 engages link 36*c*, the direction of shaft 52 is somewhat more upward than it is in FIG. 3. In the fully reclined position of FIG. 9, the shaft has its maximum upward orientation. Because the clevis mount of the motor/gear box unit 50 pivots on bracket 46, and because nut 60 pivots on stationary bracket 54, it is apparent that the direction of the shaft (thrust) is allowed to change.

It should also be noted that the motor/bear box actually moves together with the leg rest extender linkage mechanism. It has been found that this arrangement permits the most compact design and the shortest shaft, while also ensuring that the free end of the shaft remains well above the floor level at all times. While other arrangements for providing a motor thrust to the leg rest extender mechanism can be employed, the travelling motor/lead screw arrangement is preferred. However, in principle, other arrangements for providing an outwardly and upwardly directed thrust to the leg rest extender mechanism, whose direction constantly changes, may also be employed.

Figures 6, 7:
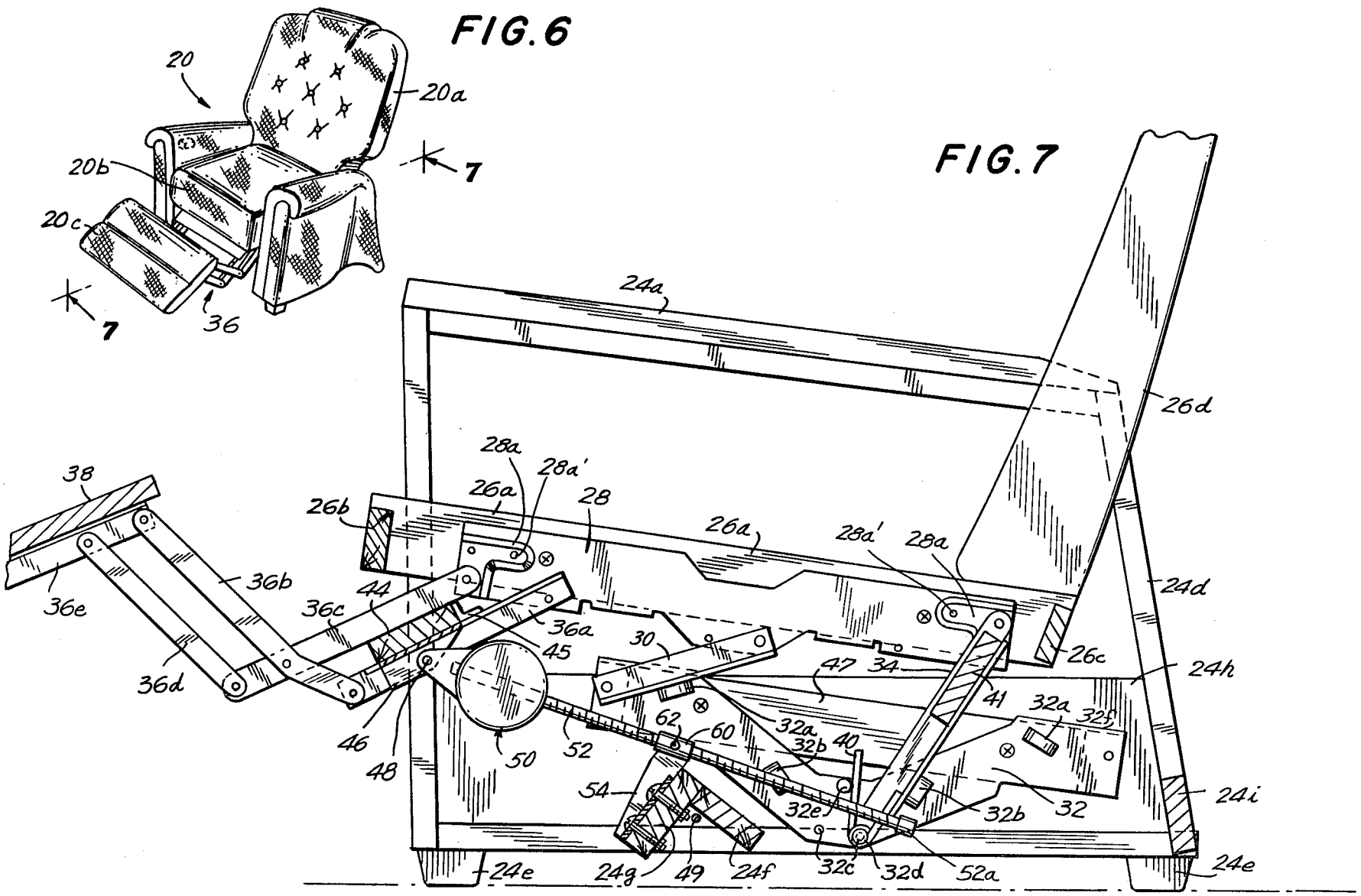
FIG. 6 depicts the chair of FIG. 1 in which the leg rest has been raised to the predetermined intermediate position.
FIG. 7 is a sectional view taken through the line 7—7 of FIG. 6.

FIG. 6 depicts the chair 20 after the leg rest has been raised to the predetermined intermediate position. During the first stage of chair operation, the seat and back do not move at all. All that happens is that the leg rest extender mechanism is extended to raise the leg rest 38. This can be seen most clearly by comparing FIGS. 3 and 7. Referring to FIG. 3, as a substantially outward horizontal thrust is applied to bracket 46, the scissors mechanism extends and the leg rest is raised to the predetermined intermediate position of FIG. 7. The two torsion springs 40 prevent any movement of the links in the two primary linkages, although even without these springs the primary linkages do not tend to change their orientations during the first motion stage. But once the leg rest is raised to the predetermined intermediate position of FIG. 7, because bracket 45 bears against link 36*c* in each mechanism, links 36*a* and 36*c* can no longer move relative to one another. The leg rest extender mechanism now moves as an integral unit. Moreover, because links 36*a* and 36*c* are both pivoted to link 28, the leg rest extender mechanism and link 28 on the seat move together as an integral unit with no relative movement between them. As an upward thrust continues to be applied to the leg rest extender mechanisms, the front end of link 28 on each side of the chair is raised. This causes the two links 30 and 34 to rotate from the positions shown in FIG. 7 to the fully reclined position of FIG. 9, against the bias of torsion spring 40. Ultimately, all of the links stop moving when the fully reclined position is reached, at which time link 34 bears against stop 32*e*, and cap 52*a* on the shaft bears against nut 60.

Several aspects of the link motions in the forward direction should be appreciated. First, until the leg rest is raised to the predetermined intermediate position of FIG. 7, the primary linkage does not move at all. Thus the seat remains stationary for any selected position of the leg rest until the leg rest is raised to the position of FIG. 7. Once the seat starts to move, however, the motion is not comparable to those of prior art reclining chairs. Most prior art reclining chair seats, when they tilt to a reclining position, are raised in the front and lowered in the back. If one looks at the bottom front and rear edges of the seat in a prior art chair, the former is raised in moving from the upright to a reclining position, but the latter is lowered. But when FIGS. 7 and 9 are compared, it is apparent that the primary linkages of our invention are configured such that the bottom rear edge of the seat actually rises (although not as much as the bottom forward edge, thus giving rise to a tilt of the seat). Because the entire seat is raised, a much more secure feeling results.

When the motor is operated in the reverse direction, it is preferable to have all of the links retrace their respective forward paths. This means that the leg rest and seat should not exhibit any relative motion as they are both returned to the intermediate position of FIG. 7, following which the leg rest alone should move as it is returned to its upright position. With prior art chairs, the seat is returned to its upright position at the same time that the leg rest is lowered relative to the seat. This means that the occupant's orientation is being changed at the same time that his legs are being lowered—an uncomfortable sensation to many persons. But by maintaining the leg rest extender mechanisms in their fully extended positions until the seat is returned to its upright position of FIG. 7, and only then having the leg rest move relative to the seat, there is only one kind of motion which the occupant experiences at any one time—either his entire body is rotated forward, or he remains stationary in the upright position in the seat with only his legs being lowered. This two-step return motion is controlled by springs 40.

Referring to FIG. 9, when a downwardly directed thrust is first applied to the leg rest extender mechanism, two types of motion would otherwise be possible. The primary links 28, 30 and 34 could remain in fixed positions with only the leg rest extender mechanism moving (retracting), or the primary linkage could start returning to its upright position with links 30 and 34 moving clockwise with the leg rest extender mechanism remaining fully extended. It is also possible for the primary linkage to start returning to its upright position at the same time that the extender mechanism is retracted. What spring 40 does is to bias link 34 clockwise so that any changes in link positions which are required by the decreasing distance between pivots 48 and 62 results in a return of the primary linkage toward the upright position, i.e., restoration of the seat, without the leg rest extender mechanism retracting at all. It is for this reason that the seat and back are restored to the upright position of FIG. 7 before the leg rest extender mechanism retracts at all. Only after the position of FIG. 7 is reached in the return direction, when links 30 and 34 bear against their respective stops, does the leg rest start moving relative to the seat and return to its upright position.

With a prior art reclining chair, should an excessive weight be applied to the leg rest (for example, by children jumping onto the legs of an adult occupant), the additional weight sometimes results in tipping over of the entire chair. But because of the "play" provided by springs 40, for any position of the chair except the fully reclined, what actually happens is that when a weight of 70–80 pounds is placed on the leg rest, the primary linkages move toward the fully reclined position. The shaft does not move, of course, but the leg rest drops down as the seat moves forward. Thus instead of the entire chair tipping over, the leg rest is lowered and the extra weight drops off.

Figure 10:
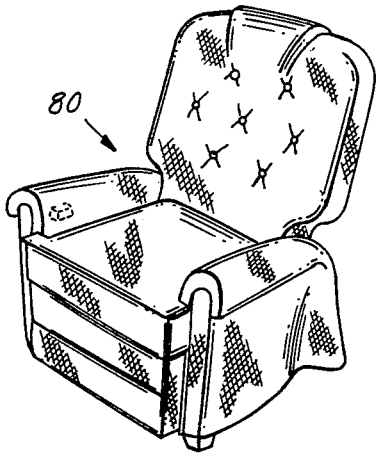
FIG. 10 depicts the second illustrative embodiment of our invention, a three-way reclining chair which employs a T-cushion.

The embodiment of the invention shown in FIG. 10 is similar to that shown in FIGS. 1, 6 and 8 except that the back is now pivoted to the seat so that a three-way operation results. Also, the chair 80 of FIG. 10 is provided with a T-cushion. In this type of styling, the cushion includes two ears which extend out in front of the chair. Prior art three-way reclining chairs have not generally been provided with T-cushions because the seat has usually moved rearward relative to the back in going from the upright to a reclining position. This, in turn, would result in the T-cushion being pushed forward on top of the seat frame. As will become apparent with reference to FIGS. 11 and 12, however, the seat of our three-way reclining chair is prevented from being pushed rearwardly relative to the bottom of the back, thus allowing T-cushion designs.

Figure 11:
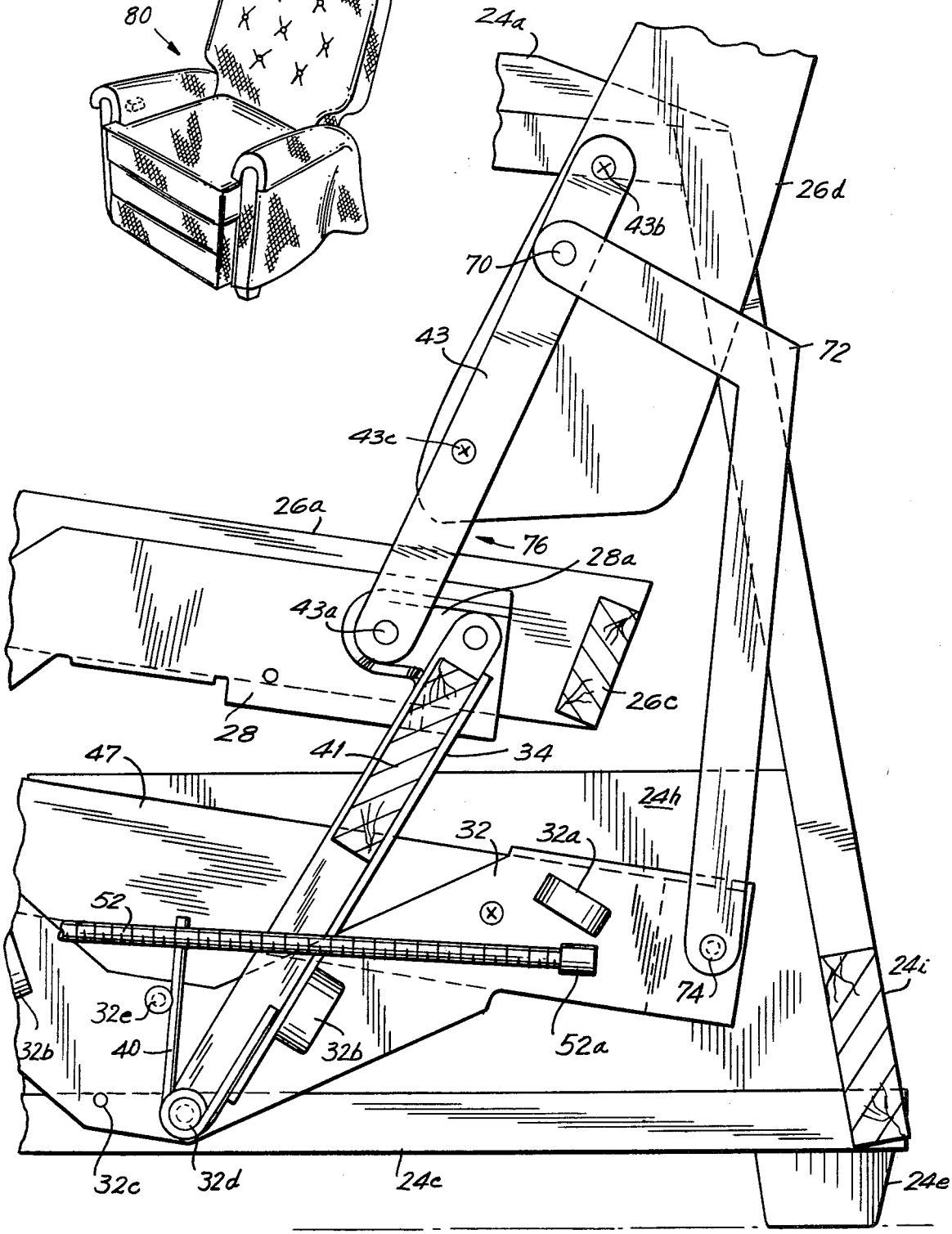
FIG. 11 is an enlarged view of a portion of the mechanism employed in the chair of FIG. 10, whose purpose is to illustrate the pivoting of the back to the seat and the additional link employed on each side of the chair.

Referring to FIG. 3, it will be noted that both of embossments 28*a* include a hole 28*a'* to which no link is pivoted in the two-way chair of FIGS. 1–9. These holes are used only when a three-way chair is constructed, and they allow the same overall linkage mechanisms to be used in both cases. Only one of the holes is used in the three-way chair, that in the rear embossment. (Once again, the provision of symmetrical links avoids the need for having different stampings for the two sides of the chair.) Back 26*d* in FIG. 11 is attached to seat 26*a* by hinge bar 43. The bar is riveted at hole 43*a*, and is secured to the back by screws 43*b*, 43*c*. In the upright position of FIG. 11 there is a small space separating the bottom of the back from the seat, as shown by the numeral 76. The only other link which is required on each side of the chair is a link 72 which is riveted at 70 to hinge bar 43, and connected by shoulder screw 74 to link 32 of the primary linkage. It should be noted that the hole for coupling link 72 to link 32 is the same hole which is used at the other side of link 32 for pivoting link 30 to it (see FIG. 3).

Figure 12:
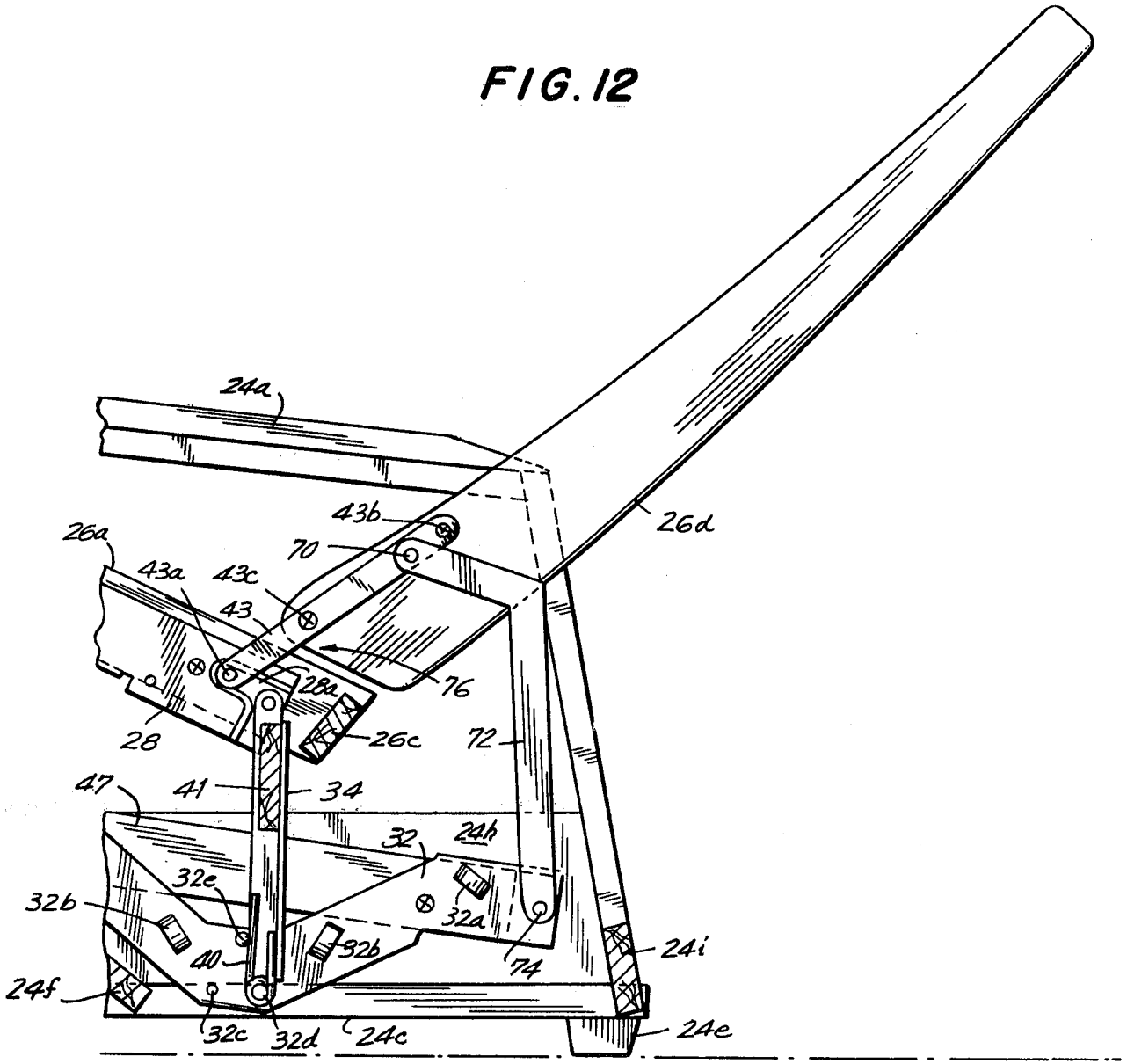
FIG. 12 is a view similar to that of FIG. 11 and depicts the relative motions of the seat and back of the chair of FIG. 10.

FIG. 12 depicts the relative link positions when the primary linkage is in the fully reclined position. The primary linkage members have the same positions in FIG. 12 that they have in FIG. 9 since the seat motion is identical for two-way and three-way chairs. Link 72 is configured such that as the rear of the seat rises and moves forward, hinge bar 43 rotates slightly in the clockwise direction around rivet 43*a*. It is thus apparent that the back tilts relative to the seat, at the same time that the back moves with the seat. The small space 76 at the bottom of the back (see FIG. 11) allows the bottom of the back to rotate to the position shown in FIG. 12.

Due to the greater leverage of the back in a reclining position in the case of the three-way chair of FIGS. 10–12, a greater force is applied (as the chair is moved to the upright position from a reclining position) which tends to lower the leg rest before the primary linkages return to their upright positions. For this reason, stronger springs 40 may have to be used (see FIG. 9). Alternatively, an additional spring on each primary linkage, pivoted where links 28 and 30 join, may be provided for biasing the two links relative to each other in the upright direction. Similarly, a tension spring, for example, connected between boards 41 and 24*i*, could provide the extra bias, or even be used instead of springs 40.

In comparing FIGS. 11 and 12, it will be apparent that the seat does not move rearwardly relative to the bottom of the back as the chair moves to the fully reclined position. It is this feature which allows T-cushion designs. Also, it is apparent that the back of the chair does not rise relative to the seat, as in some prior art three-way reclining chairs, so that the shirt of an occupant is not pulled out of his pants. Most important, three-way operation can be achieved by using the same basic mechanism employed in a two-way chair; all that is required is to pivot the back to the seat, and to provide an additional linkage on each side of the chair. The relative motions of the seat and the back are determined solely by links 72. All other link motions in the three-way chair are the same as the corresponding motions in the two-way chair.

Although the invention has been described with reference to particular embodiments, it is to be understood that these embodiments are merely illustrative of the application of the principles of our invention. Numerous modifications may be made therein and other arrangements may be devised without departing from the spirit and scope of the invention.

We claim:

1. A motorized reclining chair comprising a stationary frame; a moveable seat/back occupant support; a leg rest; a pair of quadrilateral linkages, one on each side of the chair; each of said quadrilateral linkages having a first link rigidly secured to said stationary frame, a second link rigidly secured to said moveable seat/back occupant support, and third and fourth links both connected between said first and second links; a pair of leg rest extender linkage means, one on each side of the chair, each connected between the second link of a respective quadrilateral linkage and said leg rest; a first support secured to said leg rest extender linkage means; a second support secured to said stationary frame below said moveable seat/back occupant support; shaft means extended between said first and second supports; and a manually actuatable motor for driving said shaft means to increase the distance between said first and second supports for placing the chair in a reclining condition.

2. A motorized reclining chair in accordance with claim 1 wherein in the upright position said leg rest has a vertical orientation, said leg rest extender linkage means are retracted, and the distance between said first and second supports is at a minimum.

3. A motorized reclining chair in accordance with claim 2 wherein as said shaft means increases the distance between said first and second supports from said minimum distance to a predetermined intermediate distance, said leg rest extender linkage means become fully extended and said leg rest is raised to a predetermined intermediate position without any movements of the links in said quadrilateral linkages.

4. A motorized reclining chair in accordance with claim 3 wherein as said shaft means continues to increase the distance between said first and second supports beyond said predetermined intermediate distance, continued movements of said leg rest extender linkage means cause the second links in the respective quadrilateral linkages to move therewith, whereby said seat/-back occupant support tilts to a reclining position.

5. A motorized reclining chair in accordance with claim 4 wherein said first and second supports are pivotally secured respectively to said leg rest extender means and to said stationary frame to allow the orientation of said shaft to change as the distance between said supports varies.

6. A motorized reclining chair in accordance with claim 5 wherein one of said first and second supports includes a screw nut, said shaft means is a lead screw and engages said screw nut, and said motor turns said lead screw and is secured to the other of said first and second supports.

7. A motorized reclining chair in accordance with claim 6 wherein as said shaft means decreases the distance between said first and second supports to said predetermined intermediate distance from a larger distance, the positions of said leg rest extender linkage means relative to the positions of the second links in the respective quadrilateral linkages remain fixed so that said seat/back occupant support and said leg rest move together with no relative movement therebetween.

8. A motorized reclining chair in accordance with claim 7 wherein as said shaft means continues to decrease the distance between said first and second supports below said predetermined intermediate distance, said leg rest extender linkage means are retracted and said leg rest is lowered to the upright position without any movements of the links in said quadrilateral linkages.

9. A motorized reclining chair in accordance with claim 8 further including spring means for biasing said quadrilateral linkages in the direction of the upright position.

10. A motorized reclining chair in accordance with claim 9 wherein said first link in a quadrilateral linkage is symmetrical in shape so that both of said first links are identical but oppositely disposed.

11. A motorized reclining chair in accordance with claim 10 wherein said second link in a quadrilateral linkage is symmetrical in shape so that both of said second links are identical but oppositely disposed.

12. A motorized reclining chair in accordance with claim 11 wherein the first link in each of said quadrilateral linkages includes at least one stop for bearing against at least one of the respective third and fourth links for limiting movement of said seat/back occupant support in at least one direction.

13. A motorized reclining chair in accordance with claim 12 further including means for limiting the maximum distance between said first and second supports so as to limit movement of said seat/back occupant support in the reclining direction.

14. A motorized reclining chair in accordance with claim 13 further including means to prevent the distance between said first and second supports from decreasing below said minimum distance.

15. A motorized reclining chair in accordance with claim 14 wherein said moveable seat/back occupant support includes a seat and a back rigidly secured to each other.

16. A motorized reclining chair in accordance with claim 14 wherein said moveable seat/back occupant support includes a seat and a back pivotally secured to each other, and further including a pair of links, one on each side of the chair pivotally connected at one end to the back and pivotally connected at the other end to the first link in the respective quadrilateral linkage, whereby as said seat and said back tilt to a reclining position, said back tilts relative to said seat.

17. A motorized reclining chair in accordance with claim 16 wherein said pair of links are configured to prevent said seat from moving backward relative to the bottom of said back as they both tilt to a reclining position.

18. A motorized reclining chair in accordance with claim 8 wherein said quadrilateral linkages are configured to control both the forward and rearward bottom edges of the seat/back occupant support to rise as the seat/back occupant support tilts, with the forward bottom edge rising more than the rearward bottom edge.

19. A motorized reclining chair in accordance with claim 18 wherein said quadrilateral linkages are configured to control forward movement of the seat portion of said seat/back occupant support as it tilts to a reclining position.

20. A motorized reclining chair in accordance with claim 4 wherein as said shaft means decreases the distance between said first and second supports to said predetermined intermediate distance from a larger distance, the positions of said leg rest extender linkage means relative to the positions of the second links in the respective quadrilateral linkages remain fixed so that said seat/back occupant support and said leg rest move together with no relative movement therebetween.

21. A motorized reclining chair in accordance with claim 20 wherein as said shaft means continues to decrease the distance between said first and second supports below said predetermined intermediate distance, said leg rest extender linkage means are retracted and said leg rest is lowered to the upright position without any movements of the links in said quadrilateral linkages.

22. A motorized reclining chair in accordance with claim 21 further including spring means for biasing said quadrilateral linkages in the direction of the upright position.

23. A motorized reclining chair in accordance with claim 21 wherein said moveable seat/back occupant support includes a seat and a back rigidly secured to each other.

24. A motorized reclining chair in accordance with claim 21 wherein said moveable seat/back occupant support includes a seat and a back pivotally secured to each other, and further including a pair of links, one of each side of the chair pivotally connected at one end to the back and pivotally connected at the other end to the first link in the respective quadrilateral linkage, whereby as said seat and said back tilt to a reclining position, said back tilts relative to said seat.

25. A motorized reclining chair in accordance with claim 24 wherein said pair of links are configured to prevent said seat from moving backward relative to the bottom of said back as they both tilt to a reclining position.

26. A motorized reclining chair in accordance with claim 1 further including spring means for biasing said quadrilateral linkages in the direction of the upright position.

27. A motorized reclining chair in accordance with claim 1 wherein said second link in a quadrilateral linkage is symmetrical in shape so that both of said second links identical but oppositely disposed.

28. A motorized reclining chair in accordance with claim 1 wherein said first link in a quadrilateral linkage is symmetrical in shape so that both of said first links are identical but oppositely disposed.

29. A motorized reclining chair in accordance with claim 28 wherein the first link in each of said quadrilateral linkages includes at least one stop for bearing against at least one of the respective third and fourth links for limiting movement of said seat/back occupant support in at least one direction.

30. A motorized reclining chair in accordance with claim 1 further including means for limiting the maximum distance between said first and second supports so as to limit movement of said seat/back occupant support in the reclining direction.

31. A motorized reclining chair in accordance with claim 1 further including means to prevent the distance between said first and second supports from decreasing below said minimum distance.

32. A motorized reclining chair in accordance with claim 1 wherein said moveable seat/back occupant support includes a seat and a back rigidly secured to each other.

33. A motorized reclining chair in accordance with claim 1 wherein said moveable seat/back occupant support includes a seat and a back pivotally secured to each other, and further including a pair of links, one on each side of the chair pivotally connected at one end to the back and pivotally connected at the other end to the first link in the respective quadrilateral linkage, whereby as said seat and said back tilt to a reclining position, said back tilts relative to said seat.

34. A motorized reclining chair in accordance with claim 33 wherein said pair of links are configured to prevent said seat from moving backward relative to the bottom of said back as they both tilt to a reclining position.

35. A motorized reclining chair in accordance with claim 1 wherein said quadrilateral linkages are configured to control both the forward and rearward bottom edges of the seat/back occupant support to rise as the seat/back occupant support tilts, with the forward bottom edge rising more than the rearward bottom edge.

36. A motorized reclining chair in accordance with claim 35 wherein said quadrilateral linkages are configured to control forward movement of the seat portion of said seat/back occupant support as it tilts to a reclining position.

37. A motorized reclining chair in accordance with claim 1 wherein said quadrilateral linkages are configured to control forward movement of the seat portion of said seat/back occupant support as it tilts to a reclining position.

38. A motorized reclining chair comprising a stationary frame; a moveable seat/back occupant support; a leg rest; a pair of primary linkages, one on each side of the chair; each of said primary linkages having a first link secured to said stationary frame, a second link secured to said moveable seat/back occupant support, and additional links connected between said first and second links; a pair of leg rest extender linkage means, one on each side of the chair, each connected between a respective primary linkage and said leg rest; and manually actuatable motor thrust means disposed below said moveable seat/back occupant support and connected to said leg rest extender linkage means for applying a substantially horizontal outward thrust thereto as the chair starts to move from the upright position, which thrust gradually changes in direction and becomes increasingly upward as the chair continues to move to a reclining position.

39. A motorized reclining chair in accordance with claim 38 wherein in the upright position said leg rest has a vertical orientation and said leg rest extender linkage means are retracted.

40. A motorized reclining chair in accordance with claim 39 wherein as the chair moves from the upright position, and until said leg rest extender linkage means become fully extended and said leg rest is raised to a predetermined intermediate position, there are no movements of the links in said primary linkages.

41. A motorized reclining chair in accordance with 40 wherein as said thrust continues to be applied to said leg rest extender linkage means after they become fully extended, continued movements of said leg rest extender linkage means cause the second links in the respective primary linkages to move therewith, whereby said seat/back occupant support tilts to a reclining position.

42. A motorized reclining chair in accordance with claim 41 wherein said manually actuable motor thrust means applies a downwardly directed thrust to said leg rest extender linkage means to start returning the chair from a reclining position to the upright position, which thrust gradually changes in direction and becomes increasingly rearward as the chair continues to move toward the upright position.

43. A motorized reclining chair in accordance with claim 42 wherein as said leg rest is returned from a reclining position to said predetermined intermediate position, the positions of said leg rest extender linkage means relative to the positions of the second links in the respective primary linkages remain fixed so that said seat/back occupant support and said leg rest move together with no relative movement therebetween.

44. A motorized reclining chair in accordance with claim 43 wherein as said leg rest is returned from said predetermined intermediate position to the upright position, said leg rest extender linkage means are retracted without any movements of the links in said primary linkages.

45. A motorized reclining chair in accordance with claim 44 further including spring means for biasing said primary linkages in the direction of the upright position.

46. A motorized reclining chair in accordance with claim 44 further including means for biasing said primary linkages in the direction of the upright position.

47. A motorized reclining chair in accordance with claim 44 wherein said motor thrust means includes a single motor-operated shaft which selectively pushes and pulls said leg rest extender linkage means.

48. A motorized reclining chair in accordance with claim 44 wherein said moveable seat/back occupant support includes a seat and a back rigidly secured to each other.

49. A motorized reclining chair in accordance with claim 44 wherein said moveable seat/back occupant support includes a seat and a back pivotally secured to each other, and further including a pair of links, one on each side of the chair pivotally connected at one end to the back and pivotally connected at the other end to the first link in the respective primary linkage, whereby as said seat and said back tilt to a reclining position, said back tilts relative to said seat.

50. A motorized reclining chair in accordance with claim 49 wherein said pair of links are configured to prevent said seat from moving backward relative to the bottom of said back as they both tilt to a reclining position.

51. A motorized reclining chair in accordance with claim 44 wherein said primary linkages are configured to control both the forward and rearward bottom edges of the seat/back occupant support to rise as the seat/-back occupant support tilts, with the forward bottom edge rising more than the rearward bottom edge.

52. A motorized reclining chair in accordance with claim 51 wherein said primary linkages are configured to control the forward movement of the seat portion of said seat/back occupant support as it tilts to a reclining position.

53. A motorized reclining chair in accordance with claim 38 wherein as the chair is moved in either direction between upright and fully reclined positions it passes through a predetermined intermediate position, as it moves in either direction between the upright and predetermined intermediate positions said leg rest extender linkage means moves to the exclusion of said seat/back occupant support, and as it moves in either direction between the predetermined intermediate and fully reclined positions said leg rest extender linkage means and the seat portion of said seat/back occupant support move together without any relative motion therebetween.

54. A motorized reclining chair in accordance with claim 53 further including means for controlling the paths of movement of all links in the chair to retrace themselves as the chair is moved in the two opposite directions.

55. A motorized reclining chair in accordance with claim 53 wherein said motor thrust means includes a single motor-operated shaft which selectively pushes and pulls said leg rest extender linkage means.

56. A motorized reclining chair in accordance with claim 53 wherein said moveable seat/back occupant support includes a seat and a back rigidly secured to each other.

57. A motorized reclining chair in accordance with claim 53 wherein said moveable seat/back occupant support includes a seat and a back pivotally secured to each other, and further including a pair of links, one on each side of the chair pivotally connected at one end to the back and pivotally connected at the other end to the first link in the respective primary linkage, whereby as said seat and said back tilt to a reclining position, said back tilts relative to said seat.

58. A motorized reclining chair in accordance with claim 57 wherein said pair of links are configured to prevent said seat from moving backward relative to the bottom of said back as they both tilt to a reclining position.

59. A motorized reclining chair in accordance with claim 53 wherein said primary linkages are configured to control both the forward and rearward bottom edges of the seat/back occupant support to rise as the seat/-back occupant support tilts, with the forward bottom edge rising more than the rearward bottom edge.

60. A motorized reclining chair in accordance with claim 59 wherein said primary linkages are configured to control the forward movement of the seat portion of said seat/back occupant support as it tilts to a reclining position.

61. A motorized reclining chair in accordance with claim 38 wherein said motor thrust means includes a single motor-operated shaft which selectively pushes and pulls said leg rest extender linkage means.

62. A motorized reclining chair in accordance with claim 38 wherein said moveable seat/back occupant support includes a seat and a back rigidly secured to each other.

63. A motorized reclining chair in accordance with claim 38 wherein said moveable seat/back occupant support includes a seat and a back pivotally secured to each other, and further including a pair of links, one on each side of the chair pivotally connected at one end to the back and pivotally connected at the other end to the first link in the respective primary linkage, whereby as said seat and said back tilt to a reclining position, said back tilts relative to said seat.

64. A motorized reclining chair in accordance with claim 63 wherein said pair of links are configured to prevent said seat from moving backward relative to the bottom of said back as they both tilt to a reclining position.

65. A motorized reclining chair in accordance with claim 38 wherein said primary linkages are configured to control both the forward and rearward bottom edges of the seat/back occupant support to rise as the seat/-back occupant support tilts, with the forward bottom edge rising more than the rearward bottom edge.

66. A motorized reclining chair in accordance with claim 38 wherein said primary linkages are configured to control the forward movement of the seat portion of said seat/back occupant support as it tilts to a reclining position.

67. A motorized reclining chair in accordance with claim 38 further including means for biasing said primary linkages in the direction of the upright position.

68. A motorized reclining chair in accordance with claim 38 wherein said second link in a primary linkage is symmetrical in shape so that both of said second links are identical but oppositely disposed.

69. A motorized reclining chair in accordance with claim 38 wherein said first link in a primary linkage is symmetrical in shape so that both of said first links are identical but oppositely disposed.

70. A motorized reclining chair in accordance with claim 69 wherein the first link in each of said primary linkages includes at least one stop for bearing against at least one of the respective additional links for limiting movement of said seat/back occupant support in at least one direction.

71. A motorized reclining chair in accordance with claim 38 wherein said motor thrust means includes a single motor coupled to said leg rest extender linkage means for moving therewith, a shaft actuated by said motor, and means mounted on said stationary frame and coupled to said shaft for causing a thrust to be applied to said leg rest extender linkage means as said shaft is actuated.

* * * * *